US005236021A

United States Patent [19]

Bewlay et al.

[11] Patent Number: 5,236,021

[45] Date of Patent: Aug. 17, 1993

[54] POWDER FILLING APPARATUS

[75] Inventors: Bernard P. Bewlay; Dennis J. Dalpe, both of Schenectady, N.Y.; Peter G. Frischmann, Scollsdale, Ariz.

[73] Assignee: General Electric Company, Schenectady, N.Y.

[21] Appl. No.: 812,464

[22] Filed: Dec. 23, 1991

[51] Int. Cl.[5] ..... B65B 1/14

[52] U.S. Cl. ..... 141/34; 141/284; 141/333; 141/334; 222/260

[58] Field of Search ..... 141/21, 250, 284, 331, 141/333, 334, 34, 10, 73, 317; 222/260, 261; 264/115; 366/180, 187

[56] References Cited

U.S. PATENT DOCUMENTS 1,311,955 8/1919 Edison ..... 141/34

2,690,827 5/1952 Wiggins ..... 141/34

3,155,853 11/1964 Spurlin et al. ..... 310/29

4,356,911 11/1982 Brown ..... 198/766

*Primary Examiner*—Henry J. Recla

*Assistant Examiner*—Steven O. Douglas

*Attorney, Agent, or Firm*—James E. McGinness; James Magee, Jr.

[57] ABSTRACT

A powder filling apparatus comprised of a frame means having a cylindrical channel extending therethrough. A cylindrical funnel means is rotatably mounted in the channel, the funnel means having a bore extending therethrough. The bore has an axial section for receiving a flow of powder and an angled section at a preselected angle from the axis for directing the powder flow from the funnel means. A drive means is operatively connected for rotating the funnel means.

5 Claims, 2 Drawing Sheets

POWDER FILLING APPARATUS

This application is related to copending application Ser. No. 07/646,113, filed Jan. 28, 1991.

This invention relates to an apparatus for powder filling molds, and in particular an apparatus for uniformly powder filling cylindrical molds having a high length to diameter ratio.

BACKGROUND OF THE INVENTION

The apparatus of this invention can be used for the powder filling of molds, for example, the molds used in hot isostatic pressing, dry bag cold isostatic pressing, and wet bag cold isostatic pressing. Cold isostatic pressing is described, for example in "Isostatic Pressing Technology", edited by P. J. James, Applied Science Publishers Ltd., New York, 1983, pp. 91-161, incorporated herein by reference. Cold isostatic pressing is the compaction of powders by pressing at low or ambient temperatures. A compact is formed having a green strength due to the mechanical interlocking of the powder particles. Some of the products made by cold isostatic pressing include spark plug insulators, china, and solid fuel rods. The pressed or green compact can be sintered by high temperature heating to achieve higher density and improved mechanical strength. Two of the well known cold isostatic pressing methods and the tooling associated therewith are known as the wet bag cold isostatic press and the dry bag cold isostatic press.

In dry bag cold isostatic pressing, sometimes herein referred to as dry bag pressing, an elastomeric bag or mold is fixed within a pressure vessel. The elastomeric mold has at least one open end which is sealed with the pressure vessel so that the fluid pressure medium within the vessel cannot enter the mold interior. The elastomeric mold is made from a material which does not chemically react with either the powder or the pressure medium, and readily releases from the green compact after pressing. For example, a cylindrical elastomeric mold having a high length to diameter ratio is open at both ends, and has a cylindrical void space therein. Sealing means for the open mold ends are provided by wear resistant metal punches. The punches are located and restrained by the yolk of the press, and guided into the bag by wear resistant bushes mounted in the pressure vessel. The top punch is removed and powder is charged into the void space in the mold by completely filling the void space between the sealing means. The powder filling apparatus of this invention is particularly useful in filling such molds used in dry bag or wet bag cold isostatic pressing.

An important step prior to cold isostatic pressing is powder filling of the mold cavity, preferably to a uniform fill density from top to bottom. As used herein, the term "fill density" means the density of powder in the mold prior to compaction. The uniformity of powder density in the filled mold translates into dimensional uniformity of the pressed compact. When the powder does not have a uniform fill density various non-uniformities and defects can be found in the pressed compacts. In some methods, powder is spray dried with a binder before filling to create agglomerates that will improve flowability. However, such binders can be difficult to remove and remain as undesirable contaminants in the pressed compact.

In the case of tungsten powder or other fine powder that does not freely flow, and where a binder is undesirable, cold isostatic pressing molds having a high length to diameter ratio are difficult to fill to a uniform powder density. For example, the free fall of a high density powder, such as tungsten, to the bottom of the mold can result in a higher packing at the bottom of the mold, whereas the top of the mold has a loose packing. After cold isostatic pressing, the variation in fill density produces compacted parts with a slightly conic profile where the bottom has a larger diameter. Uniform powder filling also minimizes necking in the pressed compact, usually caused by underfill or powder settlement prior to cold isostatic pressing.

An important parameter in the design and operation of the isostatic press and mold is the "compaction ratio" of the powder. The compaction ratio is the ratio between the initial fill density of the powder in the mold, and the density of the compact after isostatic pressing. The rigid punches sealing the elastomeric mold do not deform during isostatic pressing, and as a result a flare forms in the compact at the interface where the powder meets the sealing punches. The flare, sometimes known as elephant's foot, is proportional to the compaction ratio of the powder. A high powder fill density lowers the compaction ratio, and therefore reduces such flaring of the compact ends adjacent sealing punches in the mold.

Avoidance of non-uniformities and defects in pressed compacts is of greater importance in compacts subjected to additional processing, such as tungsten compacts that are sintered and wire drawn to form the filament wire in incandescent light bulbs, or molybdenum compacts that are sintered and wire drawn to form wire leads and supports in incandescent light bulbs. For example, such non-uniformities and defects in pressed compacts as described above can cause failure during wire drawing, or premature failure of the drawn filament in use as an incandescent light.

Another problem to be avoided in powder filling cold isostatic pressing molds, especially with finer powder of 2 microns or less, is the entrapment of excessive amounts of air which can be trapped between powder particles during filling. During compaction of the powder in the cold isostatic press, the entrapped air remains distributed throughout the compact in the form of small voids or high pressure pockets of air. After the cold isostatic pressing is completed the mold and compact must be decompressed. During decompression of the mold, the entrapped air pockets can apply non-uniform forces to the compact and result in breakage or damage to the compact.

It is an object of this invention to provide an apparatus for powder filling molds to a uniform fill density.

It is another object of this invention to provide an apparatus for powder filling generally cylindrical molds to have a high and uniform fill density that minimizes nonuniformities and defects in pressed compacts.

BRIEF DESCRIPTION OF THE INVENTION

The powder filling apparatus of this invention is comprised of a frame means having a cylindrical channel extending therethrough. A cylindrical funnel means is rotatably mounted in the channel, the funnel means having a bore extending therethrough. The bore has an axial section for receiving a flow of powder and an angled section at a preselected angle from the axis for directing the powder flow from the funnel means. A drive means is operatively connected for rotating the funnel means.

DETAILED DESCRIPTION OF THE INVENTION

Molds can be filled with powder particles to a high and uniform fill density by the powder filling apparatus of this invention. High and uniform fill densities in cylindrical molds, especially molds having a high length to diameter ratio, provides among other things improved dimensional uniformity in cold isostatic pressed compacts. As a result, defects are minimized and uniformity is improved in pressed compacts when cold isostatic pressing molds are filled by the apparatus of this invention.

Figure 1:
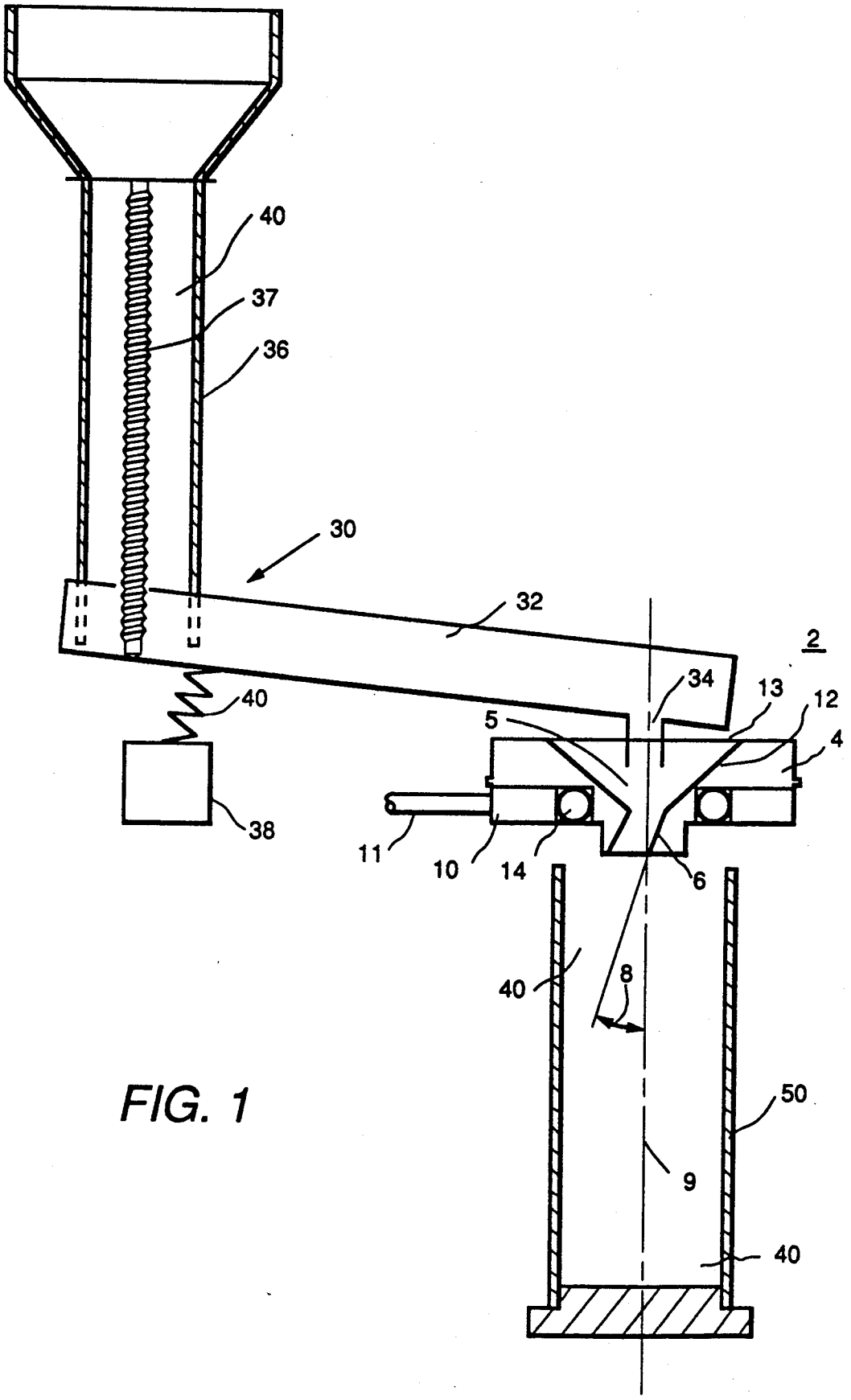
FIG. 1 is a cross-section of a side view of a powder filling apparatus and a mold.

Referring to FIG. 1, the powder pouring apparatus 2 of this invention is comprised of a frame means 10, a funnel means 4, and drive means (not shown) for rotating the funnel means. Funnel means 4 is mounted in a cylindrical channel extending through frame means 10, so that the funnel means can be rotated about the funnel axis 9. For example, funnel means 4 can be journal mounted in a bearing race 14 mounted in the cylindrical channel in frame 10. Frame 10 can be attached to a fixed or pivoting support, not shown, by rod 11. The pivoting support permits apparatus 2 to be rotated over mold 50 during powder filling, and rotated away from the mold after powder filling has been completed. The frame means 10 and funnel means 4 are formed from a wear resistant material such as stainless steel, or hardened steel, Funnel means 4 is configured to catch and direct a downward flow of powder particles. A bore 5 suitable for receiving and directing a stream of powder extends through funnel means 4. For example, the bore 5 is comprised of an axial section 12 having a generally conical shape for receiving powder, and narrows to an angled section 6 extending therefrom at a preselected angle 8, for example, of about 5° to 20°, preferably about 15° from axis 9. The angle 8 of angled section 6 is selected so that as funnel means 4 is rotated and powder is poured through the bore 5, the powder is directed from angled section 6 in a helical stream that uniformly fills a mold with spiral formed layers of the powder.

Conventional powder feed means well known to those skilled in the art can be used to supply a preselected flow rate of powder to the funnel means 4. For example, suitable powder feeding apparatus are disclosed in U.S. Pat. Nos. 3,155,853, and 4,356,911, incorporated herein by reference. Another suitable powder supply means is shown in FIG. 1. A powder feed means 30 is comprised of a tray 32 having an exit port 34 aligned over the bore 5 of the funnel means 4. A tube 36 is mounted at at preselected height over tray 32 at entrance end 35 of the tray opposite port 34. A rod 37 having a serrated surface is mounted on tray 32 so that it extends through tube 36. The tray 32 is mounted on a vibration isolating support (not shown) to provide a downward slope from the entrance end 35 to the port 34. The tube is filled with powder 40 that feeds into tray 32. Conventional armature 38 through spring 40 vibrates tray 32 directing powder from tube 36 along tray 32 to exit port 34 at a preselected flow rate. The vibration of the tray 32 also causes rod 37 to abrade the powder 40 in tube 36 so that bridging of poorly flowing powders such as tungsten is minimized.

A conventional drive means, not shown, such as a turntable drive or direct gear drive is operatively connected for rotating funnel means 4. Preferably, the drive means provides a positive drive so that there is no slippage and powder flowing from the rotating funnel means is distributed uniformly. For example, the circumference of funnel means 4 extending above frame 10 is formed as a toothed pulley. A mating toothed belt passing around the toothed outer circumference of the funnel means 4 is operatively connected to another mating toothed pulley driven by a d.c. motor, for example about 1/15 horsepower, having conventional speed control means. The toothed pulley and belt arrangement provides a positive drive to funnel means 4 so that there is no slipping during powder filling, and powder is distributed uniformly and evenly from the rotating funnel means 4. A suitable drive means turns funnel means 4 up to about 500 revolutions per minute.

In an example operation of apparatus 2, the mold 50 can be uniformly filled with tungsten powder particles. Apparatus 2 is positioned over mold 50 so that the axis 9 of funnel means 4 is incident with the axis of mold 50, and exit port 34 of the powder supply means is aligned over bore 5 of funnel means 4. The drive means (not shown) rotates funnel means 4 at a preselected rate, for example about 100 to 500, preferably about 250 revolutions per minute. Powder supply means 30 is activated to provide a preselected flow rate of the tungsten powder to the bore 5 of funnel means 4. Powder flows in a directed stream from angled section 6 into mold 50. The rotation of the funnel means 4 provides a helical stream of powder exiting the funnel means so that the powder is deposited in mold 50 in spiral formed layers that uniformly fill the mold.

We have found that poor flowing powders, such as tungsten or molybdenum, poured into the conical section 7 of the funnel means 4 can form a build up along the conical surface. Eventually, some of the powder can back up the conical surface and be expelled from the entrance end 13 of the rotating funnel means. Therefore a seal means, such as an annular member (not shown) of foamed rubber mating with the uppermost surface of funnel means 4, can be mounted between the funnel means 4 and the tray 32 to minimize the expelling of powder from the entrance end 13 of the rotating funnel means.

Figure 2:
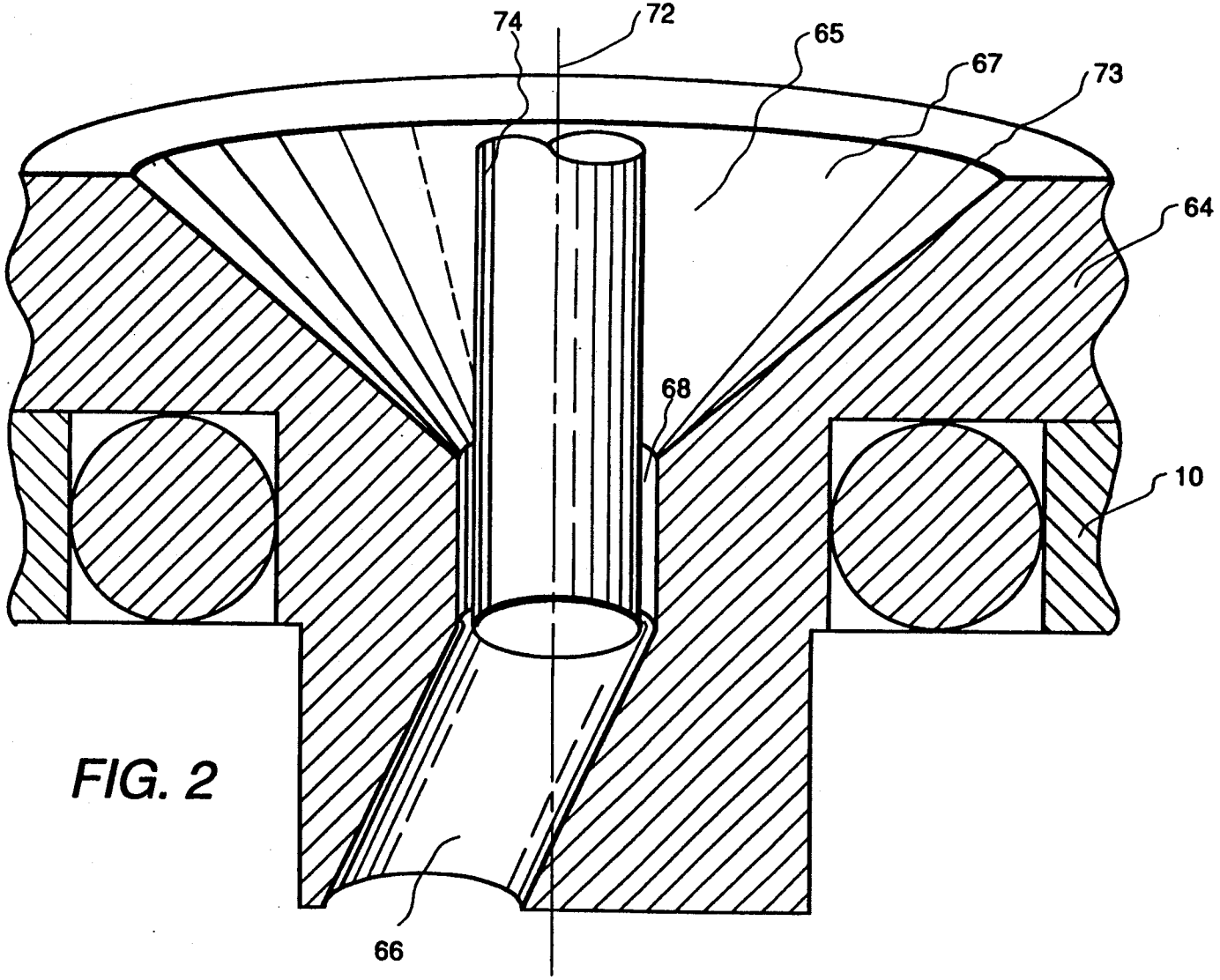
FIG. 2 is a partial cross-section of an exploded side view of a funnel in the the powder filling apparatus.

A preferred embodiment is shown by making reference to FIG. 2. Funnel means 64 is comprised of a bore 65 having a conical axial section 67 narrowing to tubular section 68. Tubular section 68 is coaxial with conical section 67, and extends to angled section 66. Angled section 66 extends from tubular section 68 at a preselected angle from axis 72. A tubular section 74, formed from a wear resistant material, extends from the exit port (as shown in FIG. 1) of the powder supply means into the tubular section 68 of funnel means 64. Funnel means 64 is rotatably mounted as described above in frame means 10.

In the preferred funnel means 64, poor flowing powders, such as tungsten or molybdenum, are directed into the tubular section 68 and through angled section 66 without experiencing the problems from powder buildup, and backup of the powder out of conical section 67. As a result, the expulsion of powder from entrance end 73 during rotation of the funnel means 64 is minimized.

What is claimed is:

1. A powder filling apparatus comprising:

a frame having a cylindrical channel extending therethrough;

a cylindrical funnel means rotatably mounted in the channel, the funnel means having a bore extending therethrough, the bore having an axial section for receiving a flow of powder and an angled section extending therefrom at a preselected angle for directing the powder flow from the funnel means, the axial section having a conical section that narrows to a tubular section, the tubular section extending to the angled section; and a drive means operatively connected for rotating the funnel means.

2. A powder filling apparatus according to claim 1 comprised of a powder feed means for providing a flow of powder to the funnel means.

3. A powder filling apparatus according to claim 2 comprising:

a cylindrical extension from the powder feed means extending into the tubular section for providing the powder flow into the tubular section.

4. A powder filling apparatus according to claim 3 wherein the preselected angle is about 5° to 20°.

5. A powder filling apparatus according to claim 1 wherein the preselected angle is about 5° to 20°.

* * * * *